US010215526B2

(12) United States Patent
Shinkle et al.

(10) Patent No.: US 10,215,526 B2
(45) Date of Patent: Feb. 26, 2019

(54) STOCK

(71) Applicant: Sig Sauer, Inc., Newington, NH (US)

(72) Inventors: Scott D. Shinkle, Greenland, NH (US); David B. Hopkins, Exeter, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 15/867,824

(22) Filed: Jan. 11, 2018

(65) Prior Publication Data

US 2018/0202756 A1 Jul. 19, 2018

Related U.S. Application Data

(60) Provisional application No. 62/446,212, filed on Jan. 13, 2017.

(51) Int. Cl.

| | |
|---|---|
| ***F41C 23/14*** | (2006.01) |
| ***F41C 23/20*** | (2006.01) |
| ***F41C 23/04*** | (2006.01) |
| ***F41C 23/08*** | (2006.01) |

(52) U.S. Cl.

CPC ..... *F41C 23/14* (2013.01); *F41C 23/04* (2013.01); *F41C 23/08* (2013.01); *F41C 23/20* (2013.01)

(58) Field of Classification Search

CPC ..... F41C 23/00; F41C 23/20; F41C 23/04; F41C 23/14; F41A 11/04; F41A 11/06

USPC ..... 42/73

See application file for complete search history.

(56) References Cited

U.S. PATENT DOCUMENTS

| | | | | |
|---|---|---|---|---|
| 1,651,299 | A * | 11/1927 | Stansel | F41C 23/14 42/73 |
| 5,392,553 | A * | 2/1995 | Carey | F41C 23/14 42/73 |
| 5,970,642 | A * | 10/1999 | Martin | F41C 23/14 42/73 |
| 7,984,580 | B1 * | 7/2011 | Giauque | F41C 23/14 42/73 |
| 8,186,090 | B1 * | 5/2012 | Chiarolanza | F41C 23/14 42/73 |
| 8,844,185 | B2 * | 9/2014 | Jarboe | F41C 23/04 42/73 |
| 8,984,790 | B2 * | 3/2015 | Wilson | F41C 23/14 42/73 |
| 9,360,272 | B2 | 6/2016 | Hopkins | |
| 9,464,863 | B2 * | 10/2016 | Mather | F41C 23/14 |
| 9,574,844 | B2 * | 2/2017 | Williams | F41B 11/721 |
| 9,664,476 | B1 * | 5/2017 | Robinson | F41C 23/04 |
| 9,664,478 | B2 * | 5/2017 | Robinson | F41C 23/04 |
| 9,664,479 | B1 * | 5/2017 | Robinson | F41C 23/14 |

(Continued)

*Primary Examiner* — Derrick R Morgan

(74) *Attorney, Agent, or Firm* — Finch & Maloney PLLC

(57) ABSTRACT

An improved buttstock for a firearm is disclosed, the buttstock comprising a comb, the comb comprising an indexing surface on a comb extension, the comb extension being configured to move between an expanded configuration and a retracted configuration; a buttstock, the buttstock comprising a buttpad extension indexing surface, the buttstock being configured to move between an expanded configuration and a retracted configuration. A common lock can secure both the comb extension and the buttpad extension in a fixed position. The common lock can release one or both of the comb extension and the buttpad extension to slide with respect to the body of the stock.

19 Claims, 9 Drawing Sheets

(56) References Cited

U.S. PATENT DOCUMENTS

| | | | | |
|---|---|---|---|---|
| 2006/0254111 | A1* | 11/2006 | Giauque | F41C 23/04 42/72 |
| 2007/0056202 | A1* | 3/2007 | Oz | F41A 23/02 42/94 |
| 2008/0028662 | A1* | 2/2008 | Abraham | F41C 23/14 42/73 |
| 2008/0236016 | A1* | 10/2008 | Fitzpatrick | F41C 23/14 42/71.01 |
| 2009/0288324 | A1* | 11/2009 | Peterson | F41A 11/02 42/75.03 |
| 2010/0212205 | A1* | 8/2010 | Nill | F41C 23/04 42/73 |
| 2012/0159828 | A1* | 6/2012 | Jarboe | F41A 3/18 42/16 |
| 2014/0196343 | A1* | 7/2014 | Wilson | F41C 23/14 42/71.01 |
| 2014/0245649 | A1* | 9/2014 | Fluhr | F41C 23/14 42/73 |
| 2014/0259848 | A1* | 9/2014 | Chvala | F41C 23/14 42/73 |
| 2015/0219416 | A1* | 8/2015 | Chvala | F41C 23/04 42/71.01 |
| 2016/0202016 | A1* | 7/2016 | Mather | F41C 23/14 42/73 |

* cited by examiner

STOCK

CROSS-REFERENCE TO RELATED APPLICATIONS

This application claims the benefit of U.S. Provisional Patent Application No. 62/446,212, filed on Jan. 13, 2017, which is herein incorporated by reference in its entirety.

FIELD OF THE INVENTION

The present disclosure relates generally to firearms and, more specifically, to an improved firearm stock.

BACKGROUND

Firearm design involves a number of non-trivial challenges, including the design of the firearm buttstock that includes a cheek rest and is typically pressed against a user's shoulder while firing. Considerations related to the design of a firearm buttstock may include the selection of various dimensions, for example, the length of pull of the firearm and the comb height.

SUMMARY OF THE INVENTION

The system and method described in the present disclosure provide an adjustable stock, which is configured to enable and/or disable motion of a comb extension and/or a buttpad extension using a single bidirectional locking mechanism.

Accordingly, pursuant to one aspect of the present invention, there is contemplated an apparatus, an adjustable stock for a firearm comprising a comb extension configured to move between an expanded configuration and a retracted configuration, the comb extension comprising a comb extension indexer positioned on a surface in a lower portion of the comb extension, a buttpad extension configured to move between an expanded configuration and a retracted configuration including a buttpad extension indexer on a surface in a forward portion of the buttpad extension, at least one stationary indexer tab in a fixed position relative to the firearm, the at least one stationary indexer tab having a first surface configured to engage the comb extension indexer and an opposed second surface configured to engage the buttpad extension indexer, and a common lock for securing the at least one stationary indexer tab to the comb extension indexer and to the buttpad extension indexer.

The invention may be further characterized by one or any combination of the features described herein, such as the common lock passes through a hole or slot in each of the stationary indexer tab, the buttpad extension indexer and the comb extension indexer, the common lock has an open position and a closed position and when in the closed position resists movement of both the comb extension and the buttpad extension, each of the buttpad extension indexer and the comb extension indexer include alternating teeth defining grooves in the indexer, the common lock comprises a cam lever, the stationary indexer tab has a first surface and a second opposed surface and the first surface defines a series of teeth having a first orientation and the second surface defines a second series of teeth, the second series of teeth having a second orientation that is about 90° to the first orientation, a second stationary indexer tab, the second stationary indexer tab in a fixed position relative to the firearm, the second stationary indexer tab having a first surface configured to engage the comb extension indexer and an opposed second surface configured to engage the buttpad extension indexer, the at least one and the second stationary indexer tab are a unitary part, the at least one and the second stationary indexer tab are biased outwardly to provide a force against the buttpad extension indexer when the buttpad extension indexer is mated with the stationary indexer tabs, two comb extension indexers, the two comb extension indexers configured to apply a compressive force to a pair of stationary indexer tabs when the comb is mated with the buttstock, each indexer comprises at least one surface that defines a set of teeth in a planar arrangement, the set of teeth are horizontally arranged, the set of teeth are vertically arranged.

Pursuant to yet another aspect of the present invention, there is contemplated a method for adjusting a firearm stock, comprising loosening a common lock, adjusting a comb height, adjusting a length of pull, tightening the single locking mechanism to fix the comb and length of pull at new locations.

The invention may be further characterized by one or any combination of the features described herein, such as expanding and retracting a buttpad extension to adjust the length of pull, expanding and retracting a comb extension to adjust the comb height, adjusting the comb height without adjusting the length of pull, adjusting the length of pull without adjusting the comb height, the comb extension and a buttpad extension are clamped around a stationary indexer comprising a series of vertical teeth on a first surface and a series of horizontal teeth on a second surface.

Further aspects, advantages and areas of applicability will become apparent from the description provided herein. It should be understood that the description and specific examples are intended for purposes of illustration only and are not intended to limit the scope of the present disclosure.

DESCRIPTION OF THE DRAWINGS

The drawings described herein are for illustration purposes only and are not intended to limit the scope of the present disclosure in any way.

DETAILED DESCRIPTION

Figure 1:
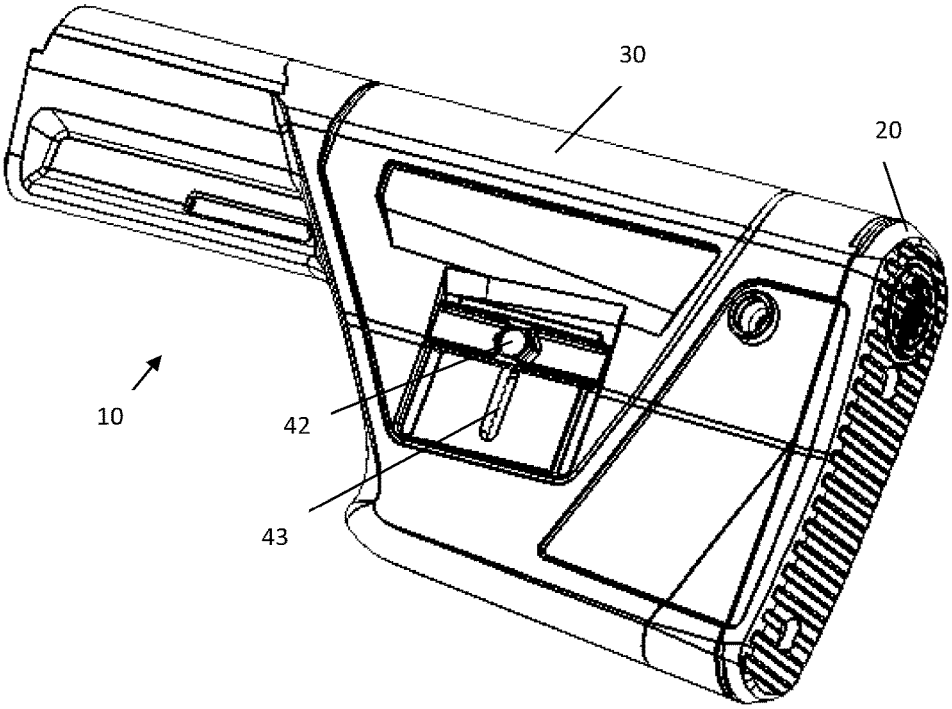
FIG. 1 illustrates a perspective view of a left side of a stock portion of a rifle in accordance with some embodiments of the present disclosure.

The following description is merely exemplary in nature and is not intended to limit the present disclosure, application, or uses. As will be seen, the devices and methods taught herein offer an improved stock.

A firearm's length of pull may be measured by taking the distance between the trigger and the end of the buttstock. When a rifle is held against a user's shoulder, the length of pull is an important factor in determining the comfort, fit, and accuracy of the firearm. The ideal length of pull for each individual is often a personal preference but often may be determined by, for example, a user's body size, the thickness of clothing being worn, or whether the user is firing from a kneeling, standing, or prone position.

Some buttstocks include an extendable buttstock recoil pad, or buttpad, which can adjust the firearm's length of pull and allow the firearm to be customized for various users and/or firing scenarios. In some cases, a buttstock recoil pad is attached to one end of an extendable arm that can telescope in and out of the body of the buttstock. Such extendable recoil pads may be secured at the desired length using various clamps or fastening techniques. However, such clamps known in the art may fail if the force applied by the fastening mechanism is not strong enough to resist the forces applied to the buttstock while firing the rifle. This problem may occur particularly with automatic rifles where the system may become shock loaded beyond the clamping force applied by the cam lever.

A firearm's comb height is the distance between the top edge of the stock and the top of the comb. It may be desirable to have an increased comb height for use with certain sights. The user's physical characteristics, such as head or shoulder size, can also be a factor in selecting an ideal comb height. It may be desirable to have a large range of motion of the comb such that the firearm is comfortable to use for a majority of users.

In one aspect, an adjustable buttstock is described herein that allows the user to adjust both the length of pull and the comb height using a single common lock. The common lock allows the user, in one motion or action, to either secure or release both an adjustable comb and an adjustable buttpad. The comb may include a comb indexer that can be secured to a stationary indexer tab on the stock. Similarly, the buttpad may include a buttpad extension indexer that can be secured to the stationary indexer tab on the stock. The common lock can apply a compression force to portions of the buttpad extension indexer. The comb indexer and the stationary indexer tab. This compression force can thereby interlock each of the buttpad extension and the comb with the buttstock and firearm. The stationary indexer tab, the comb indexer and the buttpad extension indexer can be slid together to form a sandwich structure. The sandwich can then be pressured to retain the three pieces in a locked position. In different embodiments the pieces can be slid together in any order and any arrangement.

The adjustable buttstock designs described herein can provide a mechanical functionality which is both easy to use and easy to manufacture. Different embodiments can provide an improved stock with a common lock or single fastening device to fix the length of pull and comb height in positions selected by the user. In some embodiments, the designs provide an improved stock that is configured to enable or disable two directions of motion with a common lock.

Thus, in accordance with one embodiment of the present disclosure, a common lock is disclosed, which may be, for example, a bidirectional buttstock clamp. As used herein, a bidirectional buttstock clamp is a buttstock clamp that is configured to prevent and allow movement of two portions of the stock in two different directions. In some embodiments, the buttstock clamp may be an adjustable buttstock clamp. In some embodiments bidirectional buttstock clamp may include a cam mechanism. The cam mechanism may include an eccentric camming portion that has an eccentric camming surface configured to pivot around an axis and clamp the ends of a lever arm when the lever is in the locked position.

The cam lever may rotate around a cam axis that is parallel to the axis of firing, perpendicular to the axis of firing, or anywhere there between. In one embodiment, the lock includes a tab or extension integral to the cam lever and extending perpendicularly to the cam axis beyond the eccentric camming surface. In other embodiments, a clamp can be used that surrounds the indexers and tab rather than passing through them. For example, the clamp can be a C-clamp or similar device that goes around the tab and indexers and applies pressure from opposite sides of the tab/indexer sandwich.

The improved buttstock may include a common lock that enables or prevents movement of a comb, a buttpad, or both. In some embodiments, it is contemplated that a locking mechanism, in combination with a buttpad extension and a comb extension, are configured to enable bidirectional motion. Bidirectional motion is defined as movement of parts in two directions, typically along different axes. In some embodiments, bidirectional motion can include movement along an axis in the direction of firing and along an axis perpendicular to the direction of firing. Bidirectional motion often includes independent movement of two or more parts along two or more axes.

The improved buttstock may include an indexer for fine tuning a position of a comb, for fine tuning a position of a buttpad, or both. An indexer, as used herein, is a surface with distinct positions that can be used in combination with an adjacent complementary surface which may be mated and locked in different positions. For example, an indexer may include the interaction of the two opposed washboard surfaces.

The indexer may be a horizontal indexer, a vertical indexer, a rotational indexer, or combinations thereof. In some embodiments, the vertical indexer tab on a base portion of a stock may be mated with a vertical indexer on a comb. In some embodiments, a horizontal indexer tab on a base portion of a stock may be mated with a horizontal indexer on a buttpad extension. In other embodiments, a horizontal indexer tab may mate with a comb extension and a vertical indexer may mate with a buttpad extension indexer.

An adjustable comb can be adjusted to support a user's cheek at a height suitable for use with a particular sight. Firearms including particular sights, such as telescopic sights for example, may benefit from higher combs. The length of pull can also be adjusted in order to minimize the recoil effect of firing. Further, it may be desirable to adjust and fix both a comb height and a length of pull using a common lock.

The improved buttstock described herein may provide for improvements in both ease of use and ease of manufacturing. To improve ease of use, ease of manufacturing, or both, embodiments of the design disclosed herein facilitate locking and unlocking of both a comb height adjustment and a length of pull adjustment with a common lock and a single action by the user. The common lock may include, for example, a cam lever mechanism, a clamping cam lever, an eccentric cam lever mechanism, a buttstock clamp, a nut and a bolt, a screw, or the like, or a combination thereof.

The components described herein can be, for example, molded or machined and may comprise, for example, a metal or a polymer. In some cases a stiff but resilient polymer allows for flexing of the component while allowing the component to return to its original configuration after flexing.

Figure 2:
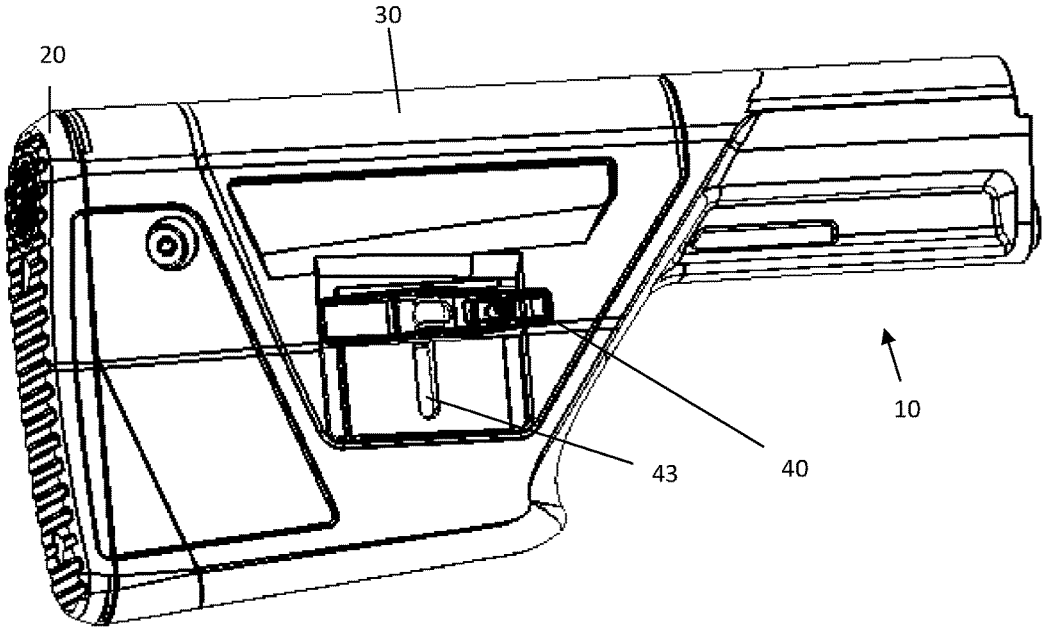
FIG. 2 illustrates a perspective view of a right side of a stock portion of a rifle in accordance with some embodiments of the present disclosure.

Turning now to the drawings to illustrate examples of embodiments of the present teachings, FIGS. 1-2 illustrate a stock assembly portion in a non-expanded configuration. Recoil pad 20 of buttpad extension 41 and comb extension 30 are both positioned in a closed, compact position on rifle 10 (i.e. buttpad extension 41 is in and comb extension 30 is down). Bolt 42 is positioned at a top portion of comb slot 43, indicating that comb extension 30 is fully in a closed position. Bolt 42 extends through comb slot 43 and engages with cam lever 40. When cam lever 40 is in a locked position, the engagement is tight, preventing movement up or down of comb extension 30. When cam lever 40 is in an unlocked position, the engagement is loosened, allowing movement up or down of comb extension 30.

Figure 3:
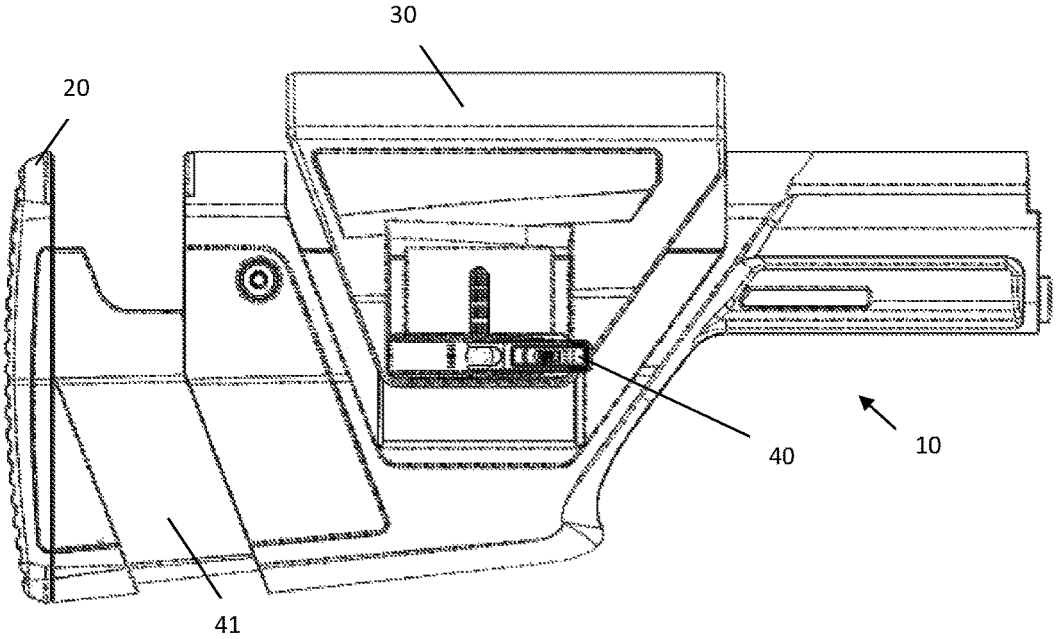
FIG. 3 illustrates a side view of a right side of a stock portion of a rifle in accordance with some embodiments of the present disclosure.
Figure 4:
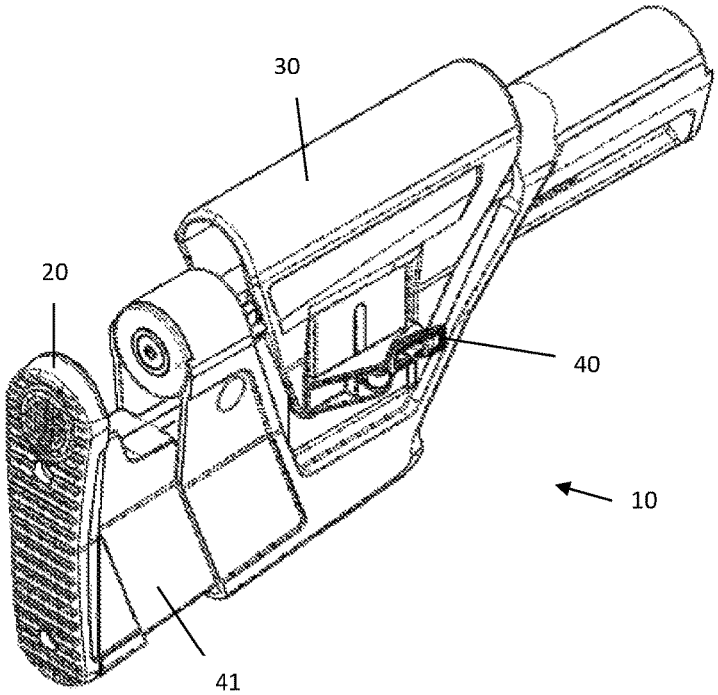
FIG. 4 illustrates a perspective view of a right side of a stock portion of a rifle in accordance with some embodiments of the present disclosure.
Figure 5:
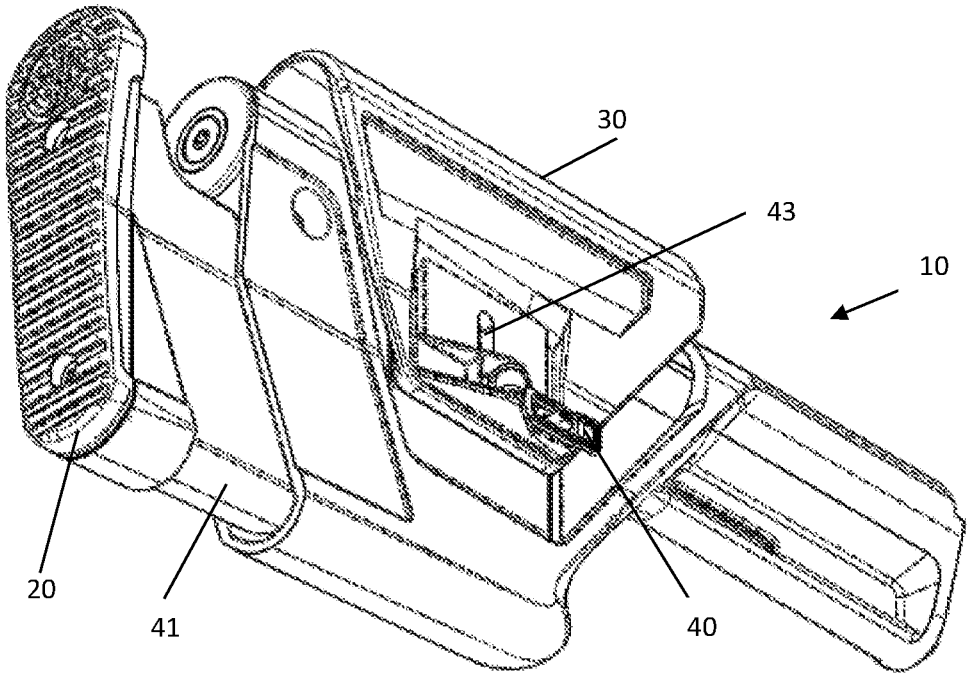
FIG. 5 illustrates a perspective view of a right side of a stock portion of a rifle in accordance with some embodiments of the present disclosure.

FIGS. 3-5 illustrate a stock assembly portion in an expanded configuration.

Buttpad extension 41 and comb extension 30 are both positioned in an expanded configuration on rifle 10 (i.e. buttpad extension 41 is out and comb extension is up). Bolt 42 and cam lever 40 are positioned at a bottom portion of comb slot 43, indicating that comb extension 30 is fully in an expanded configuration. The expanded configuration shown in FIGS. 3-5 yields a maximum comb height and maximum length of pull for a user. It is contemplated that a user may adjust a position of either comb height or length of pull independently. It is contemplated that a user may adjust a position of either comb height or length of pull into any number of different positions between the fully close and fully extended positions. It is contemplated that it may be desirable for the adjustable stock to be configured to support an infinite number of positions, between 5 and 100 different positions, between 7 and 20 different positions, or between 13 and 15 different positions.

Figure 6:
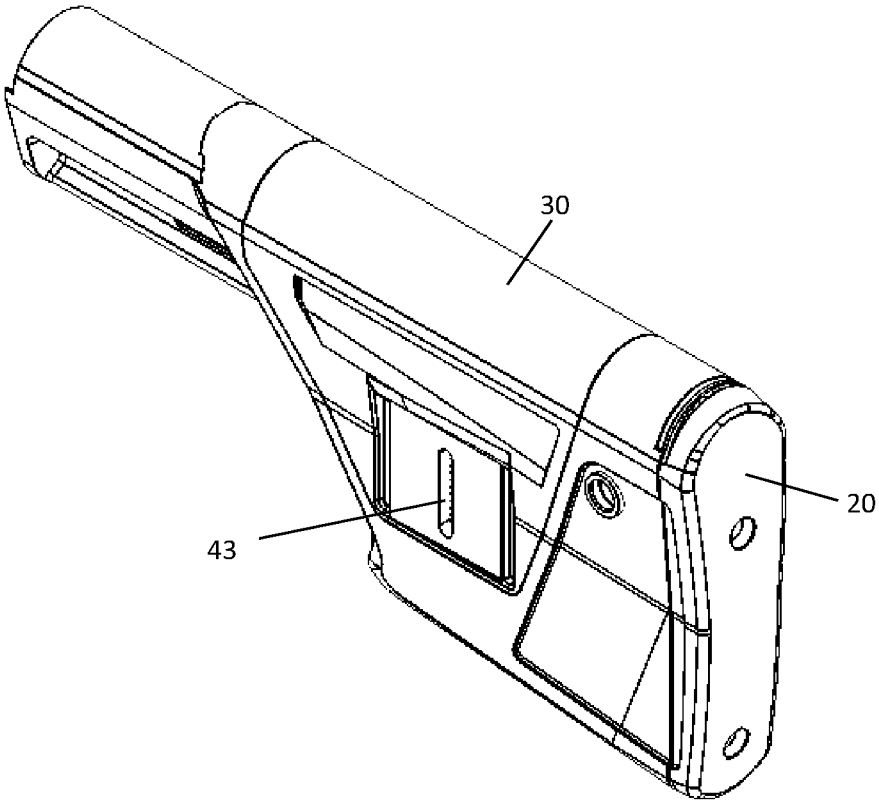
FIG. 6 illustrates a perspective view of a left side of a partial stock portion of a rifle in accordance with some embodiments of the present disclosure.
Figure 7:
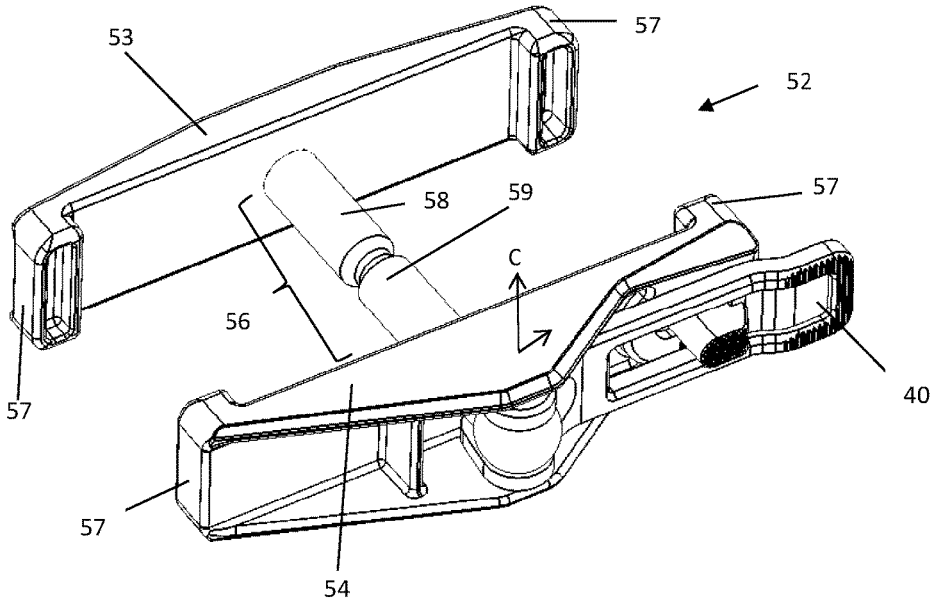
FIG. 7 illustrates a perspective view of a cam lever mechanism in accordance with some embodiments of the present disclosure.
Figure 8:
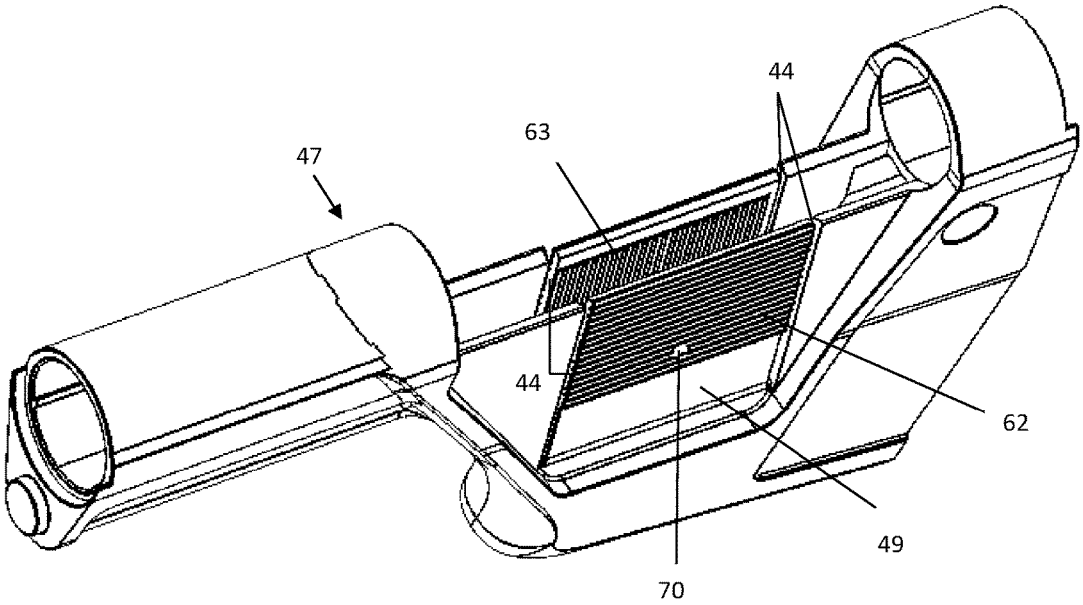
FIG. 8 illustrates a perspective view of a base portion of a stock in accordance with some embodiments of the present disclosure.
Figure 9:
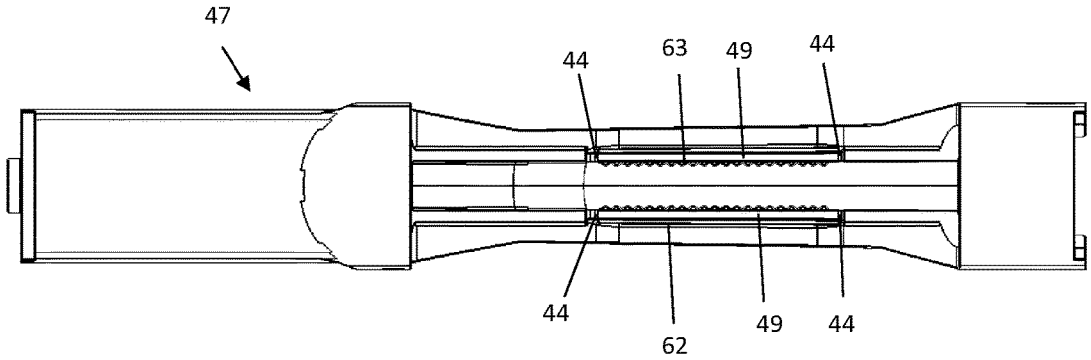
FIG. 9 illustrates a top view of a base portion of a stock in accordance with some embodiments of the present disclosure.

FIG. 6 details a left side of a stock portion of a rifle excluding the cam clamp illustrated in FIG. 7. As illustrated in FIG. 7, common lock 52 includes cam lever 40 that rotates around axis C, rectangular braces 53, 54 with end feet 57. Cam lever 40 is configured to toggle between a locked and an unlocked position. Distal brace 53 is configured to connect with proximal brace 54 via two piece connector 56. A first connector portion 58 and a second connector portion 59 may connect via threads to form two piece connector (bolt) 56, as shown in FIG. 7. End feet 57 are configured to engage with indexer edges 44, shown in FIG. 8-9, as well as rectangular cutouts 50, that are adjacent to tabs 60, shown in FIG. 11.

Figure 13:
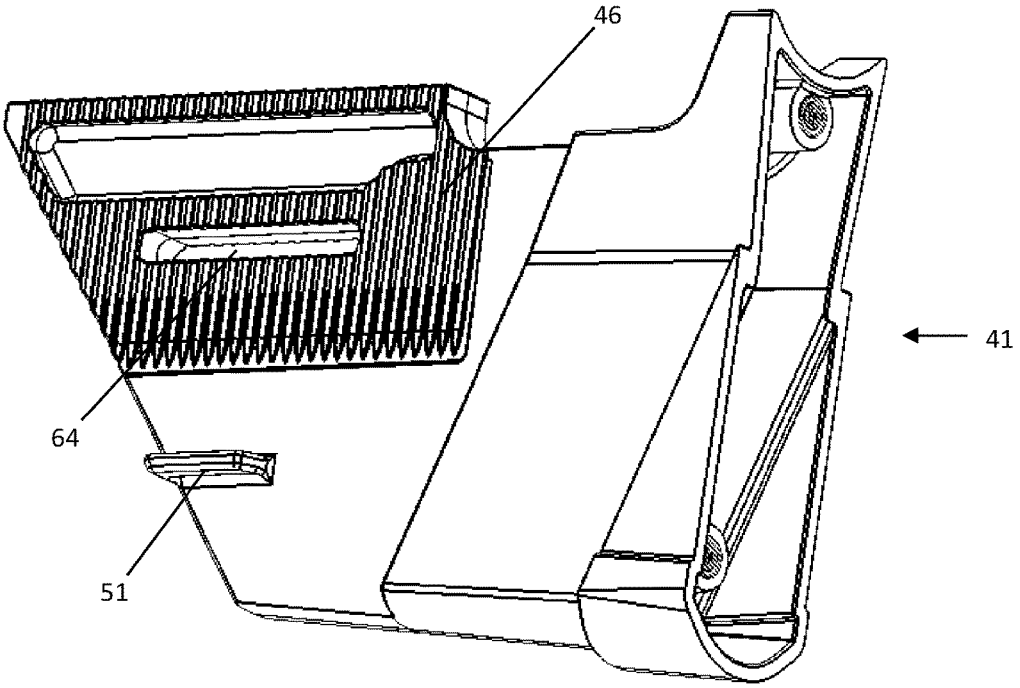
FIG. 13 illustrates a perspective view of a buttpad extension in accordance with some embodiments of the present disclosure.

Two piece connector 56 of common lock 52 is configured to slide through vertically oriented comb slot 43 of comb extension 30 (shown in FIG. 11), hole 70 in stationary indexer tab 49 of the body of the stock 47 (shown in FIG. 8), and horizontally oriented buttpad slot 64 of buttpad extension 41 (shown in FIG. 13). When common lock 52 is in a locked position, movement is prevented along vertically oriented comb slot 43 and horizontally oriented buttpad slot 64. When common lock 52 is in an unlocked position, movement may be permitted along comb slot 43, as comb extension 30 moves up and down, and along horizontally oriented buttpad slot 64, as buttpad extension 41 moves along the axis of the firearm.

Figure 11:
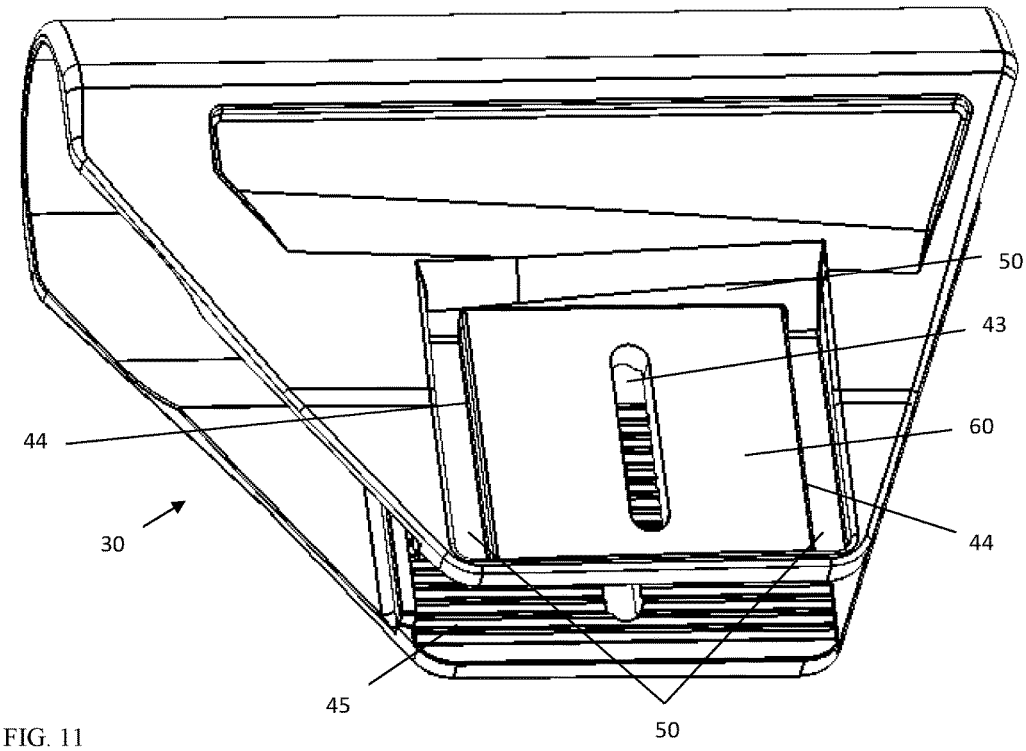
FIG. 11 illustrates a perspective view of a comb extension in accordance with some embodiments of the present disclosure.

FIG. 11 details a perspective view of comb extension 30 independent of the body of the stock 47. Indexers 60 are illustrated with vertical indexer surface 45 on an inside surface of comb extension 30. Comb extension 30 is shown with an arcuate top portion which can match with the arcuate top portion of a firearm assembly. The horizontally oriented teeth of vertical indexer 45 on an inner surface of comb extension 30 (see FIG. 11) are configured to interact with a complementary set of horizontally oriented teeth, vertical stationary indexer 62, located on the outer surface of stationary indexer tab 49 connected to the body of the stock 47 (see FIG. 8) when comb extension 30 is slid up and down along an axis perpendicular to the axis of the firearm.

Figure 12A:
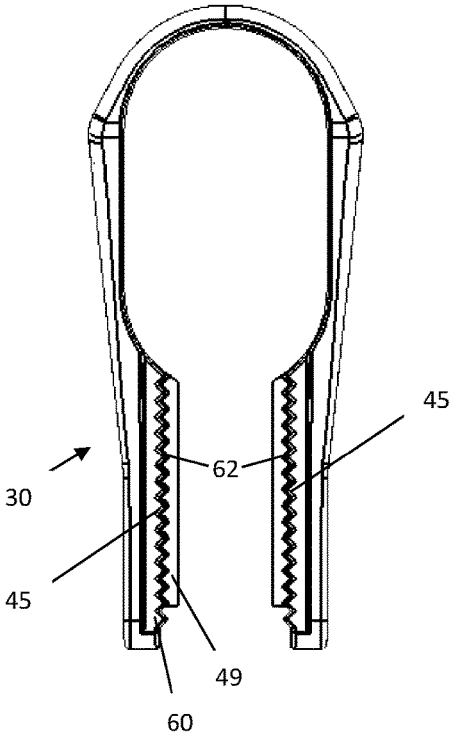
FIGS. 12A-B illustrate front and rear views, respectively, of a comb extension in accordance with some embodiments of the present disclosure.
Figure 12B:
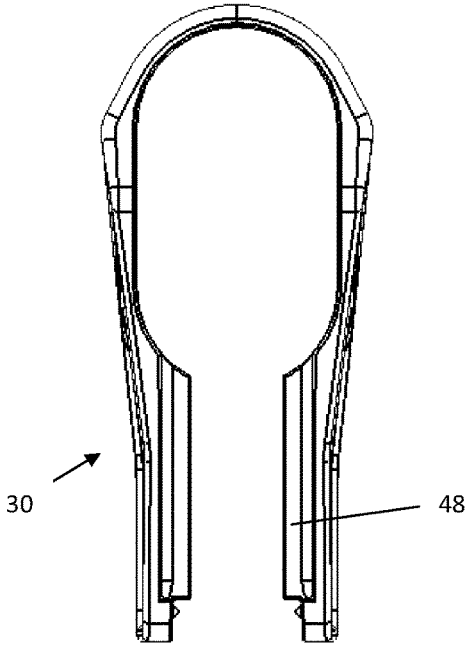

FIGS. 12 A-B show end views of comb extension 30. Vertical indexer 45 on comb extension 30 interfaces with complementary interlocking teeth on stationary indexer tab 49 that is anchored in relation to the firearm stock by two piece connector 56 (not shown). Stationary indexer tab 49 can remain in a fixed position with respect to the common lock, the stock and/or the firearm receiver, for example. When secured to the stationary indexer tab 49, the comb and the buttpad extension can also be immobilized with respect to the common lock, the stock, and/or the firearm receiver, for example. When the common lock is in unlocked, or open, mode, the comb and the buttpad extension are movable by the user in relation to the common lock, the stock and/or the firearm receiver. Boss 48 projects inwardly from the surface of stationary indexer tab 49 and can function to arrest longitudinal sliding (into or out of the sheet as shown) of buttpad extension 41. Respective vertical indexer 45 and complementary vertical stationary indexer 62 can be formed, e.g. molded or heat treated, so that they are biased against each other when installed as shown in FIGS. 12A and 12B. For example, when free of vertical stationary indexer 62, the opposed sides of comb extension 30 may be closer together than when installed around vertical stationary indexer 62. For instance, the two sides of the comb may get pulled apart when the comb slides over vertical stationary indexer 62. In a similar manner, the two opposed vertical stationary indexers 62 can be biased outwardly so that there is interaction between the teeth on vertical indexer 45 and the teeth on vertical stationary indexer 62, even when common lock 52 is not providing a compressive force to the indexer interface. This interaction can provide audio and/or tactile feedback when the user slides the comb up or down in the unlocked position. In some embodiments, this can allow the user to count the number of teeth by which the comb has been moved, either up or down, providing an indication of where the comb is situated with respect to the fully raised or fully lowered position.

It is contemplated that an indexer may be configured to make a one-to-one, two-to-one, three-to-one, or four-to-one match between the indexer on a first surface and its complementary indexer tab on a second surface. More specifically, in a two-to-one match between the indexer on a first surface and the indexer on a second surface, for example, the grooves on the first surface would have a frequency double that of the grooves on the second surface. For example, the groove frequencies could be 20 grooves per inch vs. 10 grooves per inch for the complementary surface.

Figure 10:
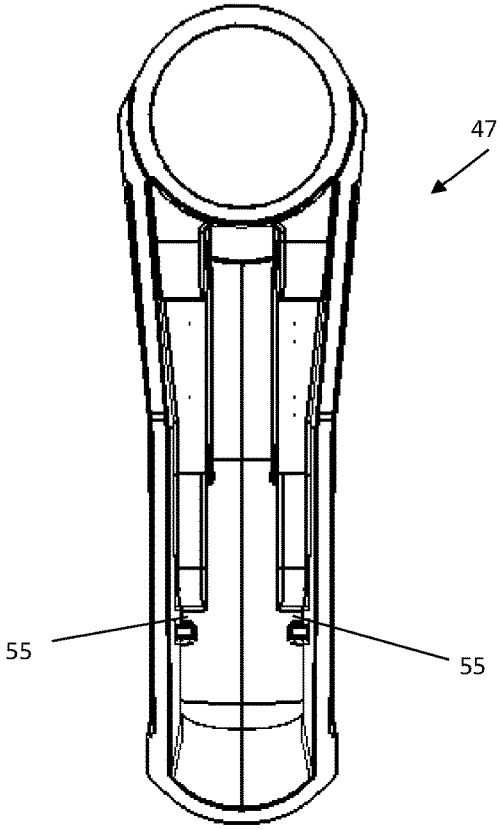
FIG. 10 illustrates a rear view of a base portion of a stock in accordance with some embodiments of the present disclosure.

FIG. 13 details a perspective view of buttpad extension 41. As illustrated, buttpad extension 41 includes horizontal indexer 46 including vertically oriented teeth as shown. The vertically oriented teeth of horizontal indexer 46 on an outer surface of buttpad extension 41 (see FIG. 13) are configured to interact with a complementary set of vertically oriented teeth, horizontal stationary indexer 63, located on the inner surface of stationary indexer tab 49 connected to the body of the stock 47 (see FIG. 8) when buttpad extension 41 is slid back and forth along the axis of the firearm. Extension guide 51 is configured to slide through groove 55 in the interior portion of the body of the stock 47, shown in FIG. 10 in order to align buttpad extension with the body of the stock 47.

Figure 14:
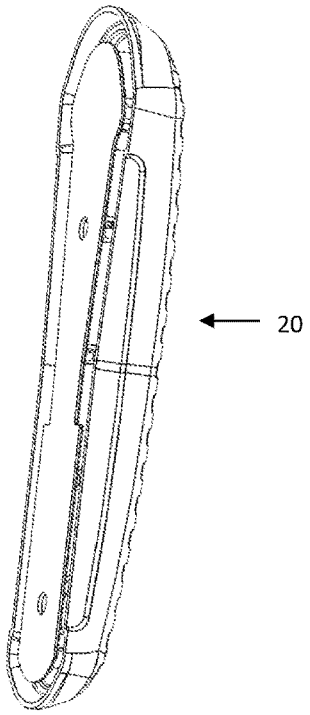
FIGS. 14-15 illustrate perspective views of portions of a buttpad extension in accordance with some embodiments of the present disclosure.
Figure 15:
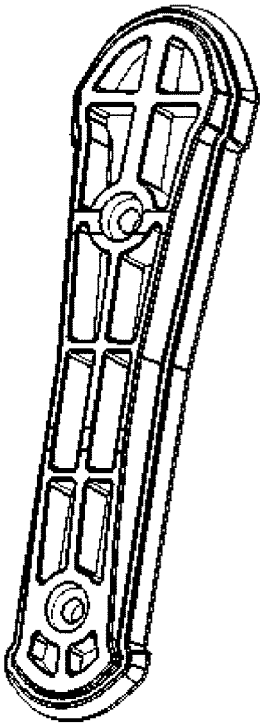

FIGS. 14-15 illustrate recoil pad 20 and the components that can be used to attach the recoil pad to buttpad extension 41. For instance, two or more screws can be used to attach the recoil pad to buttpad extension 41.

Common Lock

One embodiment of the disclosure may use a common lock for allowing or preventing movement in two different directions: e.g., movement of a comb extension up and down, perpendicular to the direction of firing, and movement of a buttpad extension in and out of the buttstock, along the direction of firing.

Functionally, when the common lock is in the unlocked position, the comb extension and the buttpad extension can move into and out of the body of the buttstock. In some cases there may be some resistance to such movement so that the user is aware of how much the comb and buttpad extension have moved. There may also be stops that prevent the comb and/or buttpad extension from disconnecting entirely from the stock. When the common lock is in the locked position, the common lock can apply a compressive force that engages the locking features of the indexer mechanism on the comb extension and on the buttpad extension to mechanically hold the comb extension and the buttpad extension at a desired position. As shown, in some embodiments this includes a stationary indexer that has horizontal teeth on one surface and vertical teeth on the opposed surface. The teeth on opposite sides may be oriented at 90 degrees to each other. When the common lock is in a locked position, a frictional resistance to movement of a first indexing surface against a second indexing surface is increased as the teeth of the indexer surfaces are tightly engaged. The frictional resistance to horizontal movement of the buttpad extension and frictional resistance to vertical movement of the comb can be increased or decreased simultaneously with the common lock. When the common lock is in an unlocked position, a frictional resistance is substantially reduced and the two mating surfaces (first indexing surface and second indexing surface) are able to slide freely to a new position. The buttpad extension and the comb can be moved independently of each other even though they can be secured by a common lock. In some embodiments, when the user applies force to either the comb or the buttpad extension, the other slidable component can remain stationary even though both slidable components can be locked in position using a single common locking mechanism. In some cases, resiliency of the teeth can contribute to immobilizing either sliding component until a force is applied by the user that overcomes the resistance provided by a slight overlapping of the interacting teeth.

In many embodiments, the common lock can be locked or unlocked with a single motion. For instance, a cam lever can be rotated about 180° between the free and locked positions. In the locked position, the opposed braces can apply enough pressure to the indexing mechanism so that the buttpad extension and comb are both locked in place. When in the open position, the opposed braces are separated enough that both the buttpad extension and the comb can be moved independently by the user. The common lock can be any connector that can alter the distance between the braces to place the indexing mechanism in a locked or unlocked position. This distance of movement can be, for example, about twice the height of the teeth on the indexer surface so that the teeth can clear each other when the common lock is in the unlocked position. In some embodiments, the common lock may be a toggle clamp, configured for pivotal movement. A toggle clamp may be any clamping mechanism that toggles between an unlocked position and a locked position and which is configured to clamp down to resist movement. In some embodiments, the common lock may be a cam lever. Movement of the common lock may typically be restricted to 270 degrees or less between a forward and rear locking position to switch between a locked and unlocked configuration. Alternatively, in some embodiments, the common lock may be configured for movement between a top and bottom locking position, or at any other angular position there between.

Structurally, the common lock may include a cam lever mechanism, a clamping cam lever, a band clamp activated by a cam lever, an eccentric cam lever mechanism, a buttstock clamp, a nut and a bolt, or a combination thereof. The common lock may include a lever arm and a base.

Functionally, the adjustable buttstock provides two mating surfaces with discrete stop points which permit the two mating surfaces to be locked down with respect to each other. Opposed indexer surfaces may create a ratcheting action with an accompanying audible click as well as a tactile indication each time the comb extension or the buttpad extension are moved from a retracted configuration to an expanded configuration, from an expanded configuration to a retracted configuration, or anywhere in between.

Structurally, the stationary indexer tab may include a set of teeth in a planar arrangement. The stationary indexer tab may include a set of horizontally-arranged teeth, a set of vertically-arranged teeth, or both. In some embodiments, one surface of a substantially planar stationary indexer tab includes vertically arranged teeth and intervening grooves, and the opposed surface of the substantially planar stationary indexer tab includes horizontally arranged teeth and intervening grooves. Thus, each surface of the indexer tab may exhibit a washboard type structure, but the grooves and ridges on the first surface can be at 90 degrees to the grooves and ridges on the opposed second surface. The horizontally-arranged teeth may control the vertical motion of a comb extension and the vertically-arranged teeth may control horizontal motion of a buttpad extension.

Each indexer may comprise a set of parallel, linear rows or arrays of teeth formed on surfaces that may be planar, square-shaped, rectangular, flexible, tabular, or a combination thereof. The horizontal and vertical teeth may be of the same size, configuration and spacing although they may be different in various embodiments. For instance, the teeth may exhibit varying amounts of sharpness and in some embodiments may have peak angles of, for example, 150°, 120°, 90°, 60° or 45° or anywhere within these ranges. These angles may be matched by the angles on the teeth in the complementary mating piece, for example, vertical indexer 45 on comb extension 30 or buttpad extension horizontal indexer 46 on buttpad extension 41. The teeth can be symmetrical but need not be. For instance, the teeth may be skewed in one direction or the other. For example, one surface of the tooth may be at 90° to the plane of the indexer tab while the other surface may be at 45° to the plane of the indexer tab. An asymmetrical tooth arrangement can be used, for example, when sliding movement in one direction is favored over the other or when the locking mechanism needs to resist a force that is stronger in one direction than the other. In one set of embodiments, greater resistance to movement is needed against compression as opposed to extension. This can be true for the buttpad extension, the comb, or both. In these cases, the stationary indexer tab may interface with the comb indexer or the buttpad extension indexer so that a 90° (angle from the plane of the indexer tab) surface on the upper edge of the horizontal teeth on the stationary indexer tab interfaces with a corresponding 90° surface on the downward facing edge of the comb indexer. This will provide additional resistance to a downward collapse of the comb. Similarly, a 90° (angle from the plane of the indexer tab) surface on the rear facing edge of the vertical teeth on the stationary indexer tab interfaces with a corresponding 90° surface on the forward facing edge of the buttpad extension indexer. This will provide additional resistance to the compressive forces on the buttstock that can occur when the firearm is fired.

Alternatively, it is contemplated that the indexer may be any surface with a coefficient of friction, any surface which is configured to provide resistance to opposed motion, or both. The indexer may serve to provide resistance to opposed motion during sliding of a first surface against a second surface, such that when a desired position is achieved for a comb extension, a buttpad extension, or both, a user will easily be able to lock down that desired position using the locking mechanism without concern over slippage between the first surface and the second surface.

Comb Extension

Functionally, the comb extension 30 is capable of moving in a vertical direction to adjust for height of the comb of a rifle during use. It may be desirable to adjust the comb extension during use of a rifle to adjust for the comb height such that a user's cheek is able to comfortably rest on the comb.

Structurally, comb extension 30 may include tab 60 with centrally located comb slot 43. The base of tab 60 is rigidly connected to the base of comb extension 30. Rectangular cutout 50 cut about the side and top edges of tab 60 allow flexibility of movement during adjustment a height of comb extension 30. Comb extension 30 may include an arcuate top portion that can mate with the arcuate top portion of a firearm assembly.

Buttpad Extension

Functionally, the buttpad extension is capable of moving in a horizontal, or close to horizontal direction to adjust for the horizontal positioning (length of pull) of the butt end of a rifle during use. It may be desirable to adjust the buttpad extension length, or length of pull, to accommodate users of different arm and/or shoulder size.

Structurally, the buttpad extension may be configured with a buttstock recoil pad and/or a buttplate at a rear end. The buttpad extension may be attached to a buttpad extension that can telescope in and out of the body of the buttstock. Buttpad extension 41 can include an indexer for longitudinally positioning the buttstock with respect to the body of the stock. Buttpad extension 41 may include an extension guide 51. Extension guide 51 can be configured to slide through a corresponding groove in the interior portion of the body of the stock in order to align buttpad extension with the body of the stock 47. It is contemplated that components including a butt pad, butt plate, or recoil pad can attach to the butt end of the buttpad extension. Two or more screw connections can be used to attach components at the butt end of the stock into buttpad extension.

The foregoing description of the embodiments of the disclosure has been presented for the purpose of illustration; it is not intended to be exhaustive or to limit the claims to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. An adjustable stock for a firearm comprising:

a comb extension configured to move between an expanded configuration and a retracted configuration, the comb extension comprising a comb extension indexer positioned on a surface in a lower portion of the comb extension;

a buttpad extension configured to move between an expanded configuration and a retracted configuration including a buttpad extension indexer on a surface in a forward portion of the buttpad extension;

at least one stationary indexer tab in a fixed position relative to the firearm, the at least one stationary indexer tab having a first surface configured to engage the comb extension indexer and an opposed second surface configured to engage the buttpad extension indexer; and a single common lock for securing the at least one stationary indexer tab to each of the comb extension indexer and the buttpad extension indexer.

2. The adjustable stock of claim 1, wherein the single common lock passes through a hole or slot in each of the at least one stationary indexer tab, the buttpad extension indexer and the comb extension indexer.

3. The adjustable stock of claim 1, wherein the single common lock has an open position and a closed position and when in the closed position resists movement of both the comb extension and the buttpad extension.

4. The adjustable stock of claim 1, wherein each of the buttpad extension indexer and the comb extension indexer include alternating teeth defining grooves in the indexer.

5. The adjustable stock of claim 1, wherein the single common lock comprises a cam lever.

6. The adjustable stock of claim 5, wherein the at least one stationary indexer tab is a first stationary indexer tab, the first stationary indexer tab is configured with a first surface and a second opposed surface and the first surface defines a series of teeth having a first orientation and the second surface defines a second series of teeth, the second series of teeth having a second orientation that is about 90° to the first orientation.

7. The adjustable stock of claim 6, comprising a second stationary indexer tab, the second stationary indexer tab in a fixed position relative to the firearm, the second stationary indexer tab having a first surface configured to engage the comb extension indexer and an opposed second surface configured to engage the buttpad extension indexer.

8. The adjustable stock of claim 7, wherein the first stationary indexer tab and the second stationary indexer tab are a unitary part.

9. The adjustable stock of claim 8, wherein the first stationary indexer tab and the second stationary indexer tab are biased outwardly to provide a force against the buttpad extension indexer when the buttpad extension indexer is mated with the stationary indexer tabs.

10. The adjustable stock of claim 9, comprising two comb extension indexers, the two comb extension indexers configured to apply a compressive force to a pair of stationary indexer tabs when the comb is mated with the buttstock.

11. The adjustable stock of claim 10, wherein each indexer comprises at least one surface that defines a set of teeth in a planar arrangement.

12. The adjustable stock of claim 11, wherein the set of teeth are horizontally arranged.

13. The adjustable stock of claim 11, wherein the set of teeth are vertically arranged.

14. A method, comprising:

utilizing the adjustable stock for a firearm of claim 1;

loosening the single common lock;

adjusting a comb height;

adjusting a length of pull; and tightening the single common lock to fix the comb and length of pull at new locations.

15. The method for adjusting a stock of claim 14, further comprising expanding and retracting a buttpad extension to adjust the length of pull.

16. The method for adjusting a stock of claim 15, further comprising expanding and retracting a comb extension to adjust the comb height.

17. The method for adjusting a stock of claim 14, further comprising adjusting the comb height without adjusting the length of pull.

18. The method for adjusting a stock of claim 14, comprising adjusting the length of pull without adjusting the comb height.

19. The method for adjusting a stock of claim 14, wherein the comb extension and a buttpad extension are clamped around a stationary indexer comprising a series of vertical teeth on a first surface and a series of horizontal teeth on a second surface.

* * * * *